US007912417B2

(12) United States Patent
Yoshida

(10) Patent No.: US 7,912,417 B2
(45) Date of Patent: Mar. 22, 2011

(54) IMAGE FORMING APPARATUS AND CONVEYANCE DEVICE

(75) Inventor: Kazuhiko Yoshida, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1032 days.

(21) Appl. No.: 11/637,166

(22) Filed: Dec. 12, 2006

(65) Prior Publication Data

US 2007/0140768 A1 Jun. 21, 2007

(30) Foreign Application Priority Data

Dec. 21, 2005 (JP) ..... 2005-367442

(51) Int. Cl.
*G03G 15/00* (2006.01)
*B65H 9/04* (2006.01)

(52) U.S. Cl. ..... 399/388; 399/395; 271/242

(58) Field of Classification Search ..... 399/308, 399/395; 271/242; 74/413, 414
See application file for complete search history.

(56) References Cited

U.S. PATENT DOCUMENTS

| | | | | |
|---|---|---|---|---|
| 6,733,009 | B2 * | 5/2004 | Ogasawara | 271/265.01 |
| 7,410,164 | B2 * | 8/2008 | Koide et al. | 271/213 |
| 2004/0094891 | A1 * | 5/2004 | Trovinger et al. | 271/227 |

FOREIGN PATENT DOCUMENTS

| | | | |
|---|---|---|---|
| JP | 05092839 | A * | 4/1993 |
| JP | 2002-156003 | | 5/2002 |
| JP | 2002-205847 | | 7/2002 |
| JP | 2003-063698 | | 3/2003 |
| JP | 2005-075490 | | 3/2005 |
| JP | 2005-239347 | | 9/2005 |
| JP | 2005-343645 | | 12/2005 |

* cited by examiner

*Primary Examiner* — Daniel J Colilla
*Assistant Examiner* — Allister Primo
(74) *Attorney, Agent, or Firm* — Morgan, Lewis & Bockius LLP

(57) ABSTRACT

An image forming apparatus includes: an image forming part; a first conveyance roller that conveys a recording medium to the image forming part; a forward/reverse-rotatable second conveyance roller, located between the first conveyance roller and the image forming part in a conveyance direction of the recording medium; a contact member, in contact with the second conveyance roller, that forms a nip between the second conveyance roller and the contact member; a first conveyance roller driver that rotate-drives the first conveyance roller in the same direction as the conveyance direction of the recording medium; and a drive transmission mechanism that performs drive transmission from the first conveyance roller driver to the second conveyance roller so as to start rotation of the second conveyance roller in a reverse direction of the conveyance direction of the recording medium before a lead edge of the recording medium arrives at the nip.

15 Claims, 9 Drawing Sheets

IMAGE FORMING APPARATUS AND CONVEYANCE DEVICE

BACKGROUND

1. Technical Field

The present invention relates to an image forming apparatus such as a copier, a facsimile machine or a printer, and a conveyance device used in the apparatus.

2. Related Art

In this type of image forming apparatus, having a first conveyance roller to convey a recording medium such as a sheet to an image forming part, a forward/reverse-rotatable second conveyance roller positioned between the first conveyance roller and the image forming part, and a contact member in contact with the second conveyance roller to form a nip, a technique of temporarily stopping a lead edge of recording medium during conveyance at the nip, thereby correcting skew of the recording medium is known.

SUMMARY

According to an aspect of the invention, there is provided an image forming apparatus including: an image forming part; a first conveyance roller that conveys a recording medium to the image forming part; a forward/reverse-rotatable second conveyance roller, located between the first conveyance roller and the image forming part in a conveyance direction of the recording medium; a contact member, in contact with the second conveyance roller, that forms a nip between the second conveyance roller and the contact member; a first conveyance roller driver that rotate-drives the first conveyance roller in the same direction as the conveyance direction of the recording medium; and a drive transmission mechanism that performs drive transmission from the first conveyance roller driver to the second conveyance roller so as to start rotation of the second conveyance roller in a reverse direction of the conveyance direction of the recording medium before a lead edge of the recording medium arrives at the nip. Accordingly, the timing of driving of the first conveyance roller can be accurately determined based on the relation with respect to the timing of driving of the second conveyance roller, and the skew correction of recording medium can be excellently performed.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Figure 1:
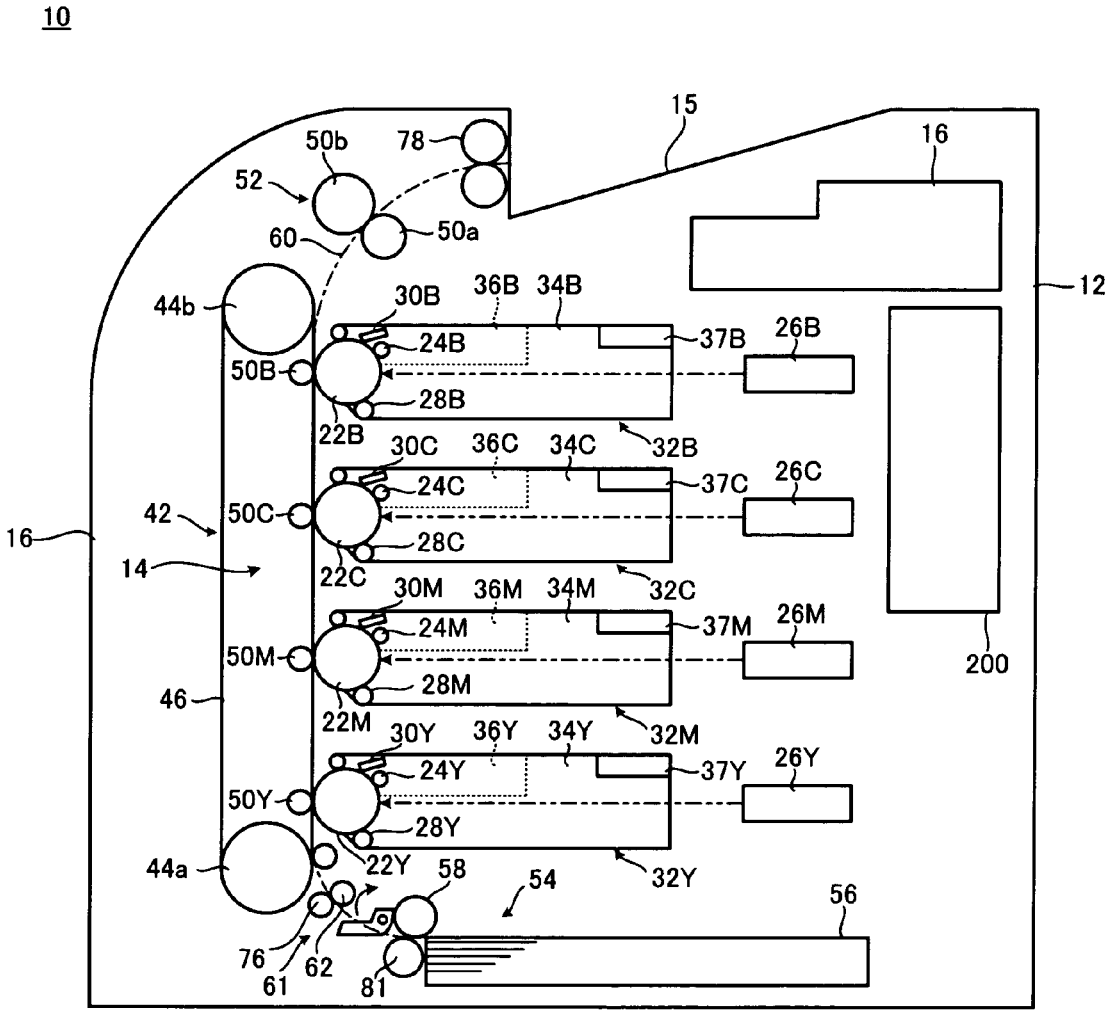
FIG. 1 is a cross-sectional view showing a structure of an image forming apparatus according to an exemplary embodiment of the present invention.
Figure 2:
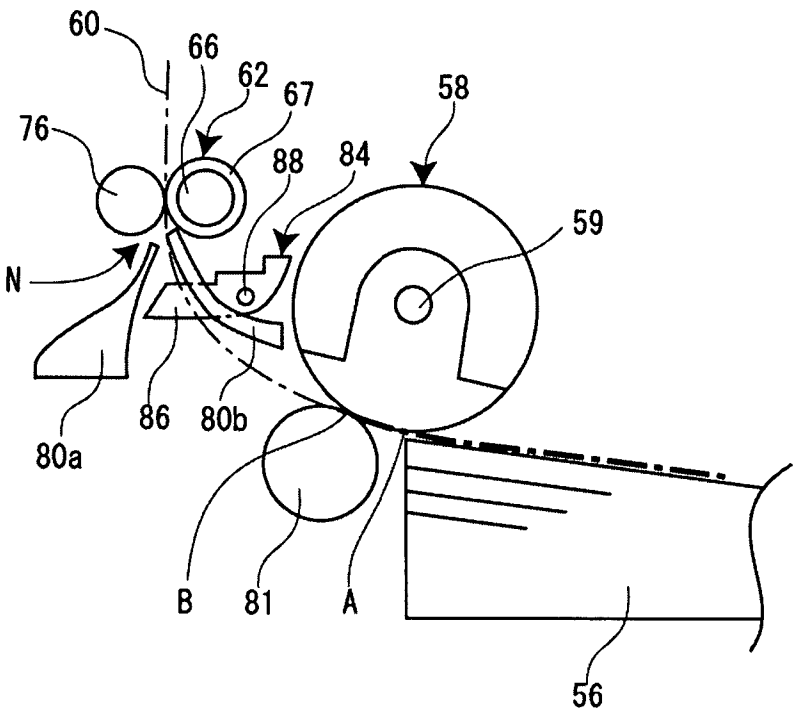
FIG. 2A is a significant-part expanded cross-sectional view of the image forming apparatus according to the exemplary embodiment of the present invention showing a status before the start of sheet conveyance.
FIG. 2B is a significant-part expanded cross-sectional view of the image forming apparatus according to the exemplary embodiment of the present invention showing a status during the sheet conveyance.
Figure 2:
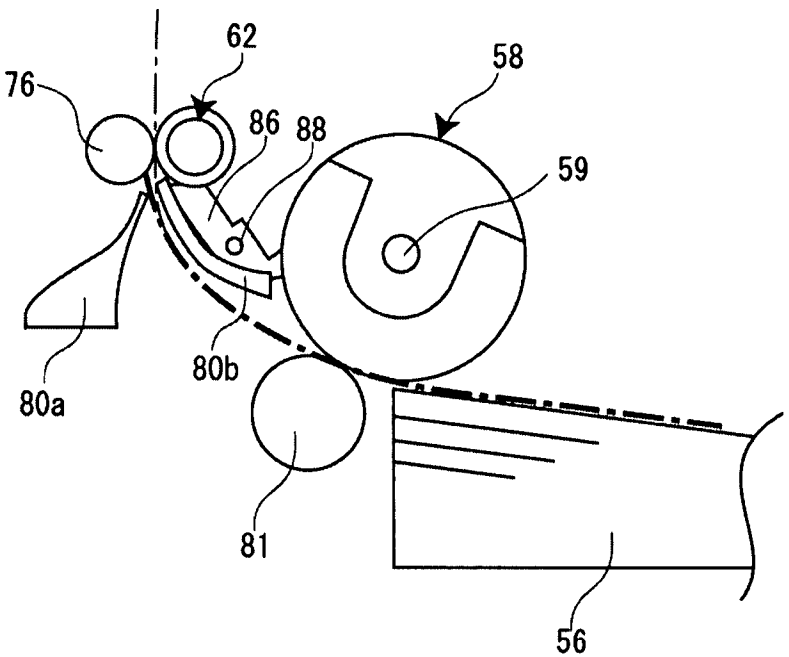

FIG. 1 shows an image forming apparatus 10 according to an exemplary embodiment of the present invention. The image forming apparatus 10 has an image forming apparatus main body 12. The image forming apparatus main body 12 includes an image forming part 14, a sheet feeder 54 to feed a sheet to the image forming part 14, a power source unit 16, and a controller 200 used as a controller. Further, a sheet discharge part 15, to which the sheet after image formation is discharged, is provided in an upper part of the image forming apparatus main body 12.

The image forming part 14 is an electrophotographic type unit to form a color image. The image forming part 14 has drum-shaped photoreceptors 22Y, 22M, 22C and 22B as image holders to hold developing material images, chargers 24Y, 24M, 24C and 24B as charging units having charging rollers to uniformly charge the respective photoreceptors 22Y, 22M, 22C and 22B, optical writers 26Y, 26M, 26C and 26B as latent-image forming units to optically write latent images on the respective photoreceptors 22Y, 22M, 22C and 22B, developing devices 28Y, 28M, 28C and 28B as developing units to develop the latent images written on the respective photoreceptors 22Y, 22M, 22C and 22B with developing material (toner), a transfer unit 42 as a transfer unit to transfer the developing material images formed on the respective photoreceptors 22Y, 22M, 22C and 22B to a sheet, and cleaners 30Y, 30M, 30C and 30B as developing-material removal units to remove the developing material remaining on the photoreceptors 22Y, 22M, 22C and 22B after the transfer of the developing material images by the transfer unit 42.

The optical writers 26Y, 26M, 26C and 26B respectively have a laser exposure device. The optical writer 26Y emits a laser beam corresponding to a yellow image to the photoreceptor 22Y; the optical writer 26M, a laser beam corresponding to a magenta image to the photoreceptor 22M; the optical writer 26C, a laser beam corresponding a cyan image to the photoreceptor 22C; and the optical writer 26B, a laser beam corresponding to a black image to the photoreceptor 22B. In this manner, the optical writers 26Y, 26M, 26C and 26B respectively write latent images on the photoreceptors 22Y, 22M, 22C and 22B.

Among the units included in the image forming part 14, the photoreceptor 22, the charger 24, the developing device 28 and the cleaner 30 are integrated as a process cartridge 32 used as an exchangeable unit. The process cartridge is attachable/removable to/from the image forming apparatus main body 12. Further, the process cartridge 32 has a toner cartridge (toner bottle) 34 as a developing material container (exchangeable unit) containing developing material (toner) supplied to the developing devices 28, and a discharge toner bottle 36 as a developing-material collecting container to collect developing material (toner) removed by the cleaner 30, attachably/removably or integrally with the process cartridge 32.

In the image forming apparatus main body 12, the process cartridges 32Y, 32M, 32C and 32B are arrayed, in this order, from a lower position toward an upper position in FIG. 1, along a conveyance belt 46 to be described later.

The process cartridge 32Y is used for image formation with yellow developing material; the process cartridge 32M, for image formation with magenta developing material; the process cartridge 32C, for image formation with cyan developing material; and the process cartridge 32B, for image formation with black developing material. Accordingly, the toner cartridge 34Y is filled with yellow toner; the toner cartridge 34M, magenta toner; the toner cartridge 34C, cyan toner; and the toner cartridge 34B, black toner.

The transfer unit 42 is provided in contact with the photoreceptors 22Y, 22M, 22C and 22B of the process cartridges 32Y, 32M, 32C and 32B. The transfer unit 42 has two support rollers 44*a* and 44*b* integrated as a unit, the conveyance belt 46 as a conveyance unit to convey a sheet or image, an attachment roller 48 as an attachment unit to attach the sheet to the conveyance belt 46, and transfer rollers 50Y, 50M, 50C and 50B to transfer developing material images formed on the respective photoreceptors 22Y, 22M, 22C and 22B onto the sheet conveyed with the conveyance belt 46.

The attachment roller 48 is provided in press-contact with the support roller 44*a* via the conveyance belt 46. The attachment roller 48 receives a voltage applied from the power source unit 16 and electrostatically attaches the sheet to the conveyance belt 46.

A transfer bias is applied to the respective transfer rollers 50Y, 50M, 50C and 50B, to sequentially transfer developing material images formed on the photoreceptors 22Y, 22M, 22C and 22B to the sheet conveyed with the conveyance belt 46, thus a color developing-material image is formed with overlaid four color images, i.e., yellow, magenta, cyan and black developing material images.

Further, a fixing device 52 to fix the developing material image, transferred on the sheet by the transfer unit 42, onto the sheet, is provided in the upper part of the image forming apparatus main body 12. The fixing device 52, having a heating roller 52*a* and a pressure roller 52*b*, fixes the developing material image to the sheet by heating and pressing the sheet passing between the heating roller 52*a* and the pressure roller 52*b*.

Further, a conveyance path 60 to convey a sheet supplied from the sheet feeder 54 to the sheet discharge part is provided in the image forming apparatus main body 12. Along the conveyance path 60, registration rollers 62 and 76, the transfer unit 42, the fixing device 52 and a discharge roller 78 are provided sequentially from the upstream side of sheet conveyance direction. The discharge roller 78 discharges the sheet conveyed from the fixing device 52 to the sheet discharge part 15.

FIGS. 2 to 7 show the details of the sheet feeder 54. The sheet feeder 54 has a sheet feed cassette 56 containing sheets, and a feed roller 58 to feed a sheet from the sheet feed cassette 56 toward the image forming part 14.

The sheet feed cassette 56, in which sheets such as normal sheets or OHP sheets are stacked, is provided attachably/removably to/from the image forming apparatus main body 12. The sheet feed cassette 56 is used as a recording medium container, and also used as a conveyance-subject container.

The feed roller 58 has a meniscus core 58*a* fixed to a rotation shaft 59, and disk-shaped skids 58*b* provided at both ends of the core 58*a*. The core 58*a* has a diameter slightly larger than that of the skids 58*b*, and eccentric from the rotation shaft 59 by the large-diameter portion. The feed roller 58 is in contact with a handling roller 81 having a member with a high surface frictional force. The skids 58*b* of the feed roller 58 are rotated in contact with the handling roller 81 in accordance with rotation of the rotation shaft 59. As the core 58*a* having a meniscus shape is eccentric, when the skids 58*b* are rotated, the core 58*a* is rotated intermittently in contact with a sheet on the top of the sheet pile stacked on the sheet feed cassette 56, thereby the top sheet is fed. At this time, when plural sheets are held between the feed roller 58 and the handling roller 81, the handling roller 81 is stopped or reverse-rotated, so as to cause slipping between the sheets and feed only the top sheet.

When plural sheets have been held between the feed roller 58 and the handling roller 81 and only the top sheet has been fed with the handling roller 81, a lead edge of the sheet to be fed next is located in a position where the feed roller 58 and the handling roller 81 are in contact with each other, or a position around the contact position. On the other hand, when only the top sheet has been fed with the feed roller 58, the lead edge of the sheet to be fed next is located at the end of the sheet feed cassette 56. In this manner, the position of the lead edge of the sheet to be fed is different in accordance with whether or not the previous sheet has been fed with the handling roller 81.

A pair of registration rollers 61 is provided on the downstream side of the feed roller 58 and the handling roller 81. The pair of registration rollers 61 has a registration roller 62 and a registration roller 76. The registration roller 62, as a driving side, rotates in a sheet conveyance reverse direction at predetermined timing, and rotates in the same direction as the sheet conveyance direction at predetermined timing. The registration roller 76, as a driven side, is rotated in accordance with the rotation of the registration roller 62.

The registration roller 62 has four cores 66 fixed to a rotation shaft 64, and the cores 66 are provided with rubber members 67 of rubber having a high surface friction force. The cores 66 are rotated in contact with the registration roller 76 in accordance with rotation of the rotation shaft 64.

The registration roller 76, in press-contact with the cores 66 of the registration roller 62, is rotated in accordance with driving of the registration roller 62. The registration roller 76, of metal, has at least a surface of a material with a surface frictional coefficient lower than that of the surface of the registration roller 62.

The registration roller 62 and the registration roller 76 form a nip N. Guide plates 80*a* and 80*b* to guide a sheet to the nip N are provided upstream of the nip N.

As shown in FIGS. 2A and 2B, the guide plates 80*a* and 80*b* are opposite to each other, with the conveyance path 60 therebetween, upstream of the nip N. As shown in FIG. 2B, the guide plates 80*a* and 80*b* guide a sheet fed from the feed roller 58 so as to bring the lead edge of the sheet into contact with the registration roller 76. In this manner, the guide plates 80*a* and 80*b* are used as a guide unit for the registration roller 76, as one of the registration rollers forming the nip N, at least having a surface frictional coefficient lower than that of the registration roller 62, to guide a sheet so as to bring the lead edge of the sheet into contact with the registration roller 76.

Further, a sensor 84 to detect timing of arrival of the lead edge of the sheet at the nip N and to detect timing of passing of the trail edge of the sheet through the nip N is provided in a position upstream of the nip N and close to the nip N.

The sensor 84 has a movable member 86 rotatably supported with a shaft 88. As shown in FIG. 2A, when a sheet is not passed, the movable member 86 is in a position crossing the conveyance path 60. From this state, when a sheet has been fed with the feed roller 58, as shown in FIG. 2B, the lead edge of the sheet pushes the movable member 86, and against a pressure by a pressure unit having a spring (not shown), rotates the movable member 86 about the shaft 88, to move the movable member 86 outside the conveyance path 60. Then the movement of the movable member 86 is detected by an optical sensor (not shown), thus the timing of arrival of the sheet at the nip N is detected.

When the trail edge of the sheet has been passed through the position of the sensor 84, the movable member 86 again moves to the position crossing the conveyance path 60 shown in FIG. 2A. As the movement is detected by the optical sensor (not shown), the timing of passing of the trail edge of the sheet through the nip N is detected. In this manner, the sensor 84 is used as a detection unit to detect the timing of passing of the trail edge of the sheet through the nip N.

A feed roller driving mechanism 100 to rotate-drive the feed roller 58 in the sheet conveyance direction is attached to the feed roller 58.

Figure 3:
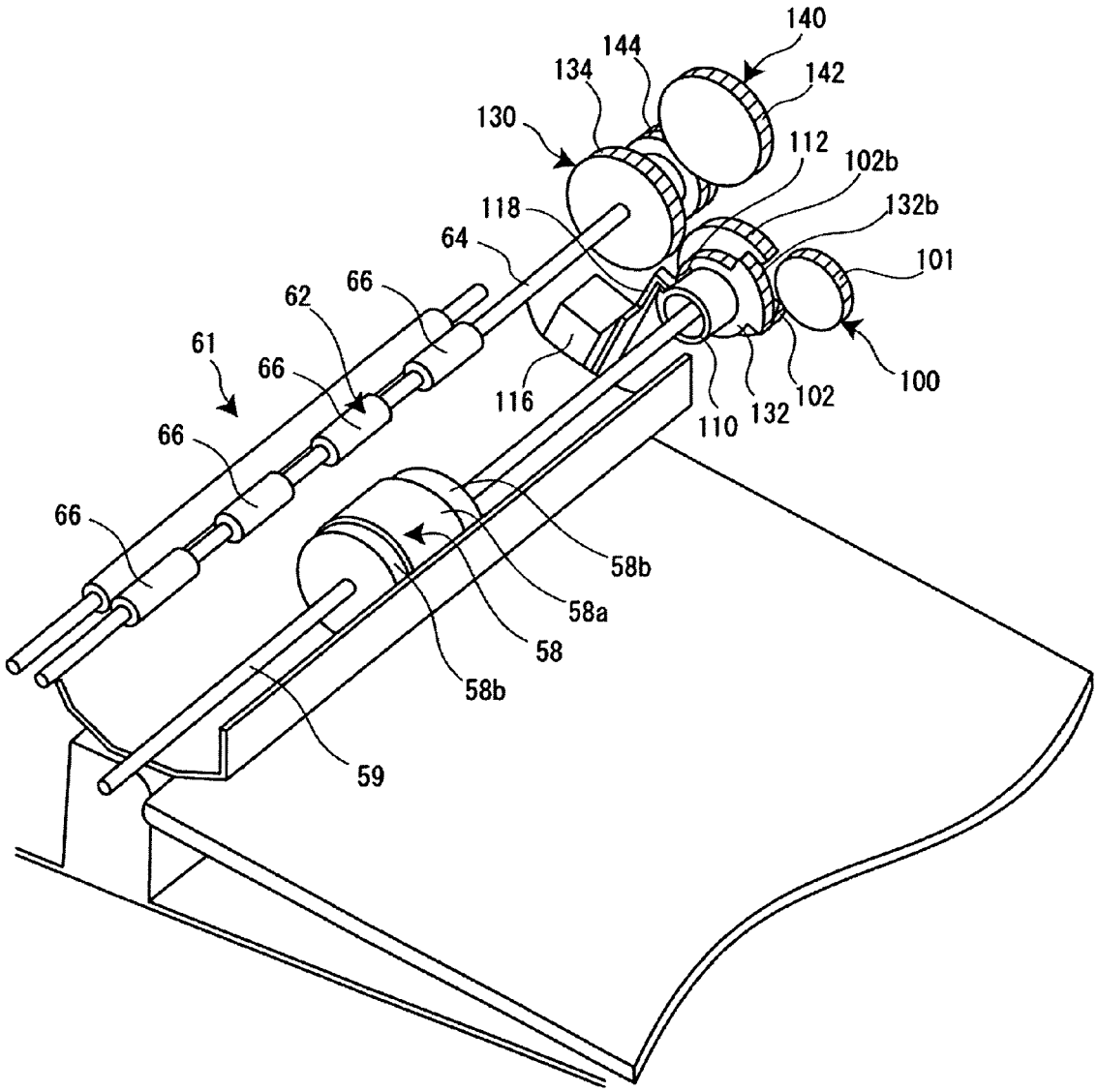
FIG. 3 is a perspective diagram showing a paper feeder employed in the image forming apparatus according to the exemplary embodiment of the present invention viewed from a front position.
Figure 4:
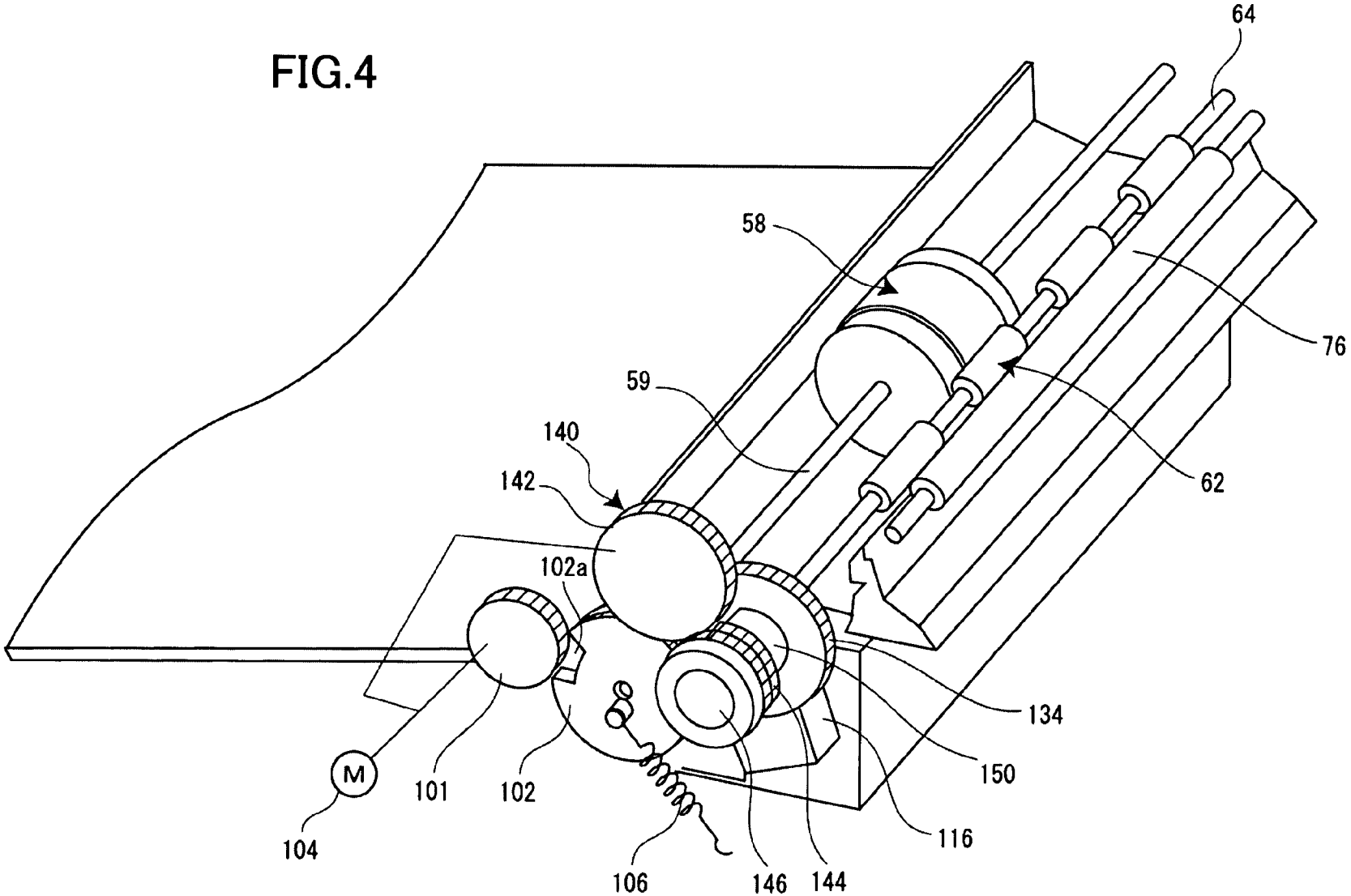
FIG. 4 is a perspective diagram showing the paper feeder employed in the image forming apparatus according to the exemplary embodiment of the present invention viewed from a rear position.

The feed roller driving mechanism 100 has a driving gear 101 and a driven gear 102. The driving gear 101 receives drive transmission from a motor 104 used as a drive source and is rotated. The driven gear 102 is a notched gear fixed to one end of the rotation shaft 59. The driven gear 102 has a notch portion 102*a* having no tooth. When the notch portion 102*a* is opposite to the driving gear 101, the driving gear 101 runs idle, and the drive from the driving gear 101 is not transmitted to the driven gear 102. As shown in FIG. 4, the driven gear 102 is connected to one end of a pressure unit 106 having an elastic body such as an extension spring, and the driven gear is pressurized in one direction with the pressure unit 106. Further, as shown in FIG. 3, a cylindrical member 110 having a claw 112 is fixed to the rotation shaft 64, to which the driven gear 102 is fixed, and a movable member 118 of a solenoid 116 is engaged with the claw 112. Accordingly, when the solenoid 116 is driven from the state shown in FIG. 3, the engagement between the movable member 118 and the claw 112 is released, then the driven gear 102 is rotated by the pressure of the pressure unit 106, and the driving gear 101 engages with a gear portion 102*b* of the driven gear 102. In this state, drive transmission is performed from the driving gear 101 to the driven gear 102, and the feed roller 58 starts rotation in the sheet conveyance direction together with the driven gear 102 and the rotation shaft 64.

A drive transmission mechanism 130 to transmit driving to rotate the registration roller 62 in a reverse direction of the sheet conveyance direction from the feed roller driving mechanism 100 to the registration roller 62 is attached to the feed roller driving mechanism 100.

The drive transmission mechanism 130 has a transmission gear 132 and a reverse gear 134.

Figure 5:
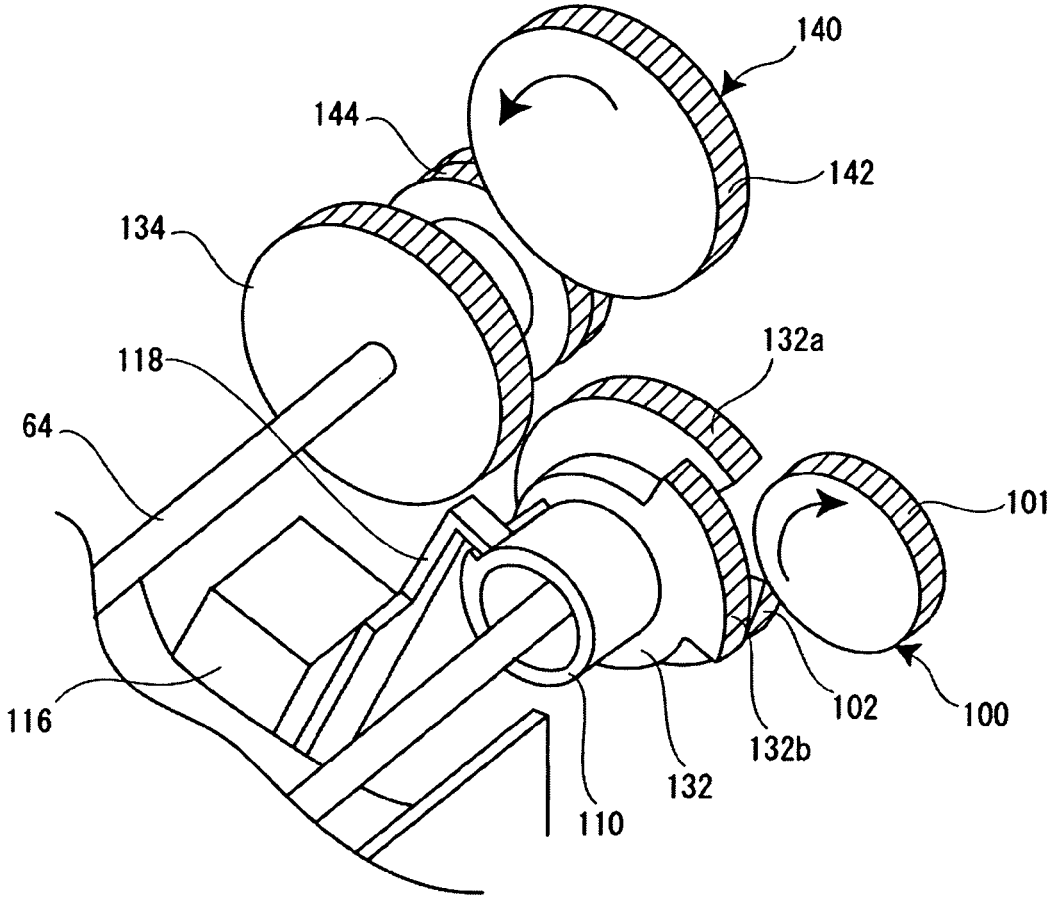
FIG. 5 is a perspective diagram showing a state at start of gear array drive to transmit driving to a paper feed roller and a registration roller of the image forming apparatus according to the exemplary embodiment of the present invention, viewed from a front position.
Figure 6:
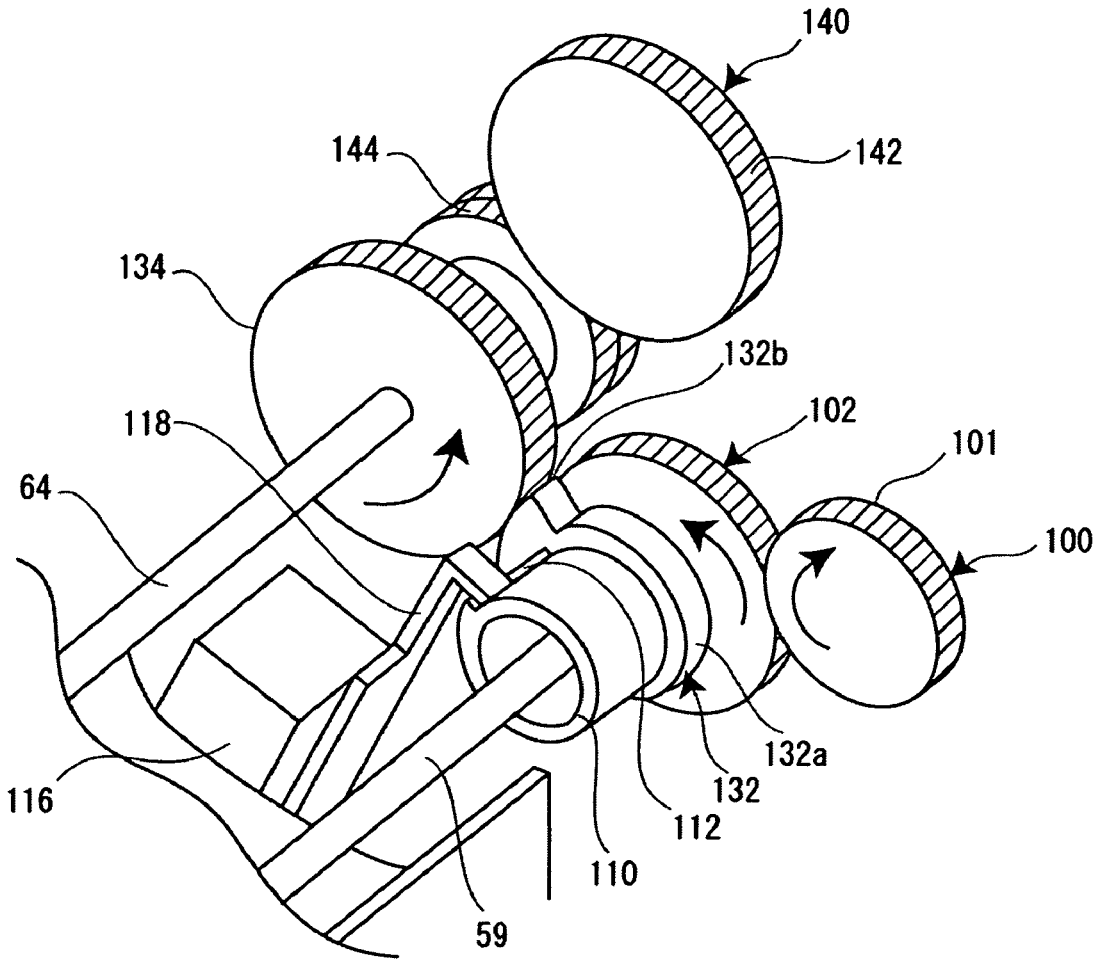
FIG. 6 is a perspective diagram showing a state during the gear-array drive to transmit driving to the paper feed roller and the registration roller of the image forming apparatus according to the exemplary embodiment of the present invention, viewed from a front position.

The transmission gear 132 is a notched gear fixed to the rotation shaft 59 in a position between the driven gear 102 and the cylindrical member 110. The transmission gear 132 has a notch portion 132*a* having no tooth and a gear portion 132*b* with teeth. As shown in FIG. 5, when the notch portion 132*a* is opposite to the reverse gear 134, the transmission gear 132 runs idle, and drive transmission is not performed from the transmission gear 132 to the reverse gear 134. As described above, when the engagement between the movable member 118 of the solenoid 116 and the claw 112 of the cylindrical member 110 is released and the driven gear 102, the rotation shaft 59 and the feed roller 58 start rotation, the transmission gear 132 fixed to the rotation shaft 59 starts rotation. When the transmission gear 132 rotates and the gear portion 132*b* of the transmission gear 132 moves to a position opposite to the reverse gear 134 as shown in FIG. 6, the transmission gear 132 engages with the reverse gear 134, then drive transmission is performed from the transmission gear 132 to the reverse gear 134, and the reverse gear 134 and the rotation shaft 64 start rotation. As the rotation shaft 64 rotates, the registration roller 62 is rotated in the reverse direction of the sheet conveyance direction.

In the drive transmission mechanism 130, as the transmission gear 132 rotates, the gear portion 132*b* passes through the position opposite to the reverse gear 134, and when the notch portion 132*a* moves to the position opposite to the transmission gear 132, the transmission gear 132 runs idle and the drive transmission from the transmission gear 132 to the reverse gear 134 is stopped. Note that the positions and length of the notch portion 132*a* and the gear portion 132*b* of the transmission gear 132 are determined so as to cause the registration roller 62 to start rotation in the reverse direction of the sheet conveyance direction before arrival of the sheet fed with the feed roller 58 at the nip N and to stop the drive transmission to the registration roller 62 after the arrival of the sheet at the nip N.

A registration roller driving mechanism 140 to rotate the registration roller 62 in the same direction of the sheet conveyance direction is attached to the registration roller 62.

Figure 7:
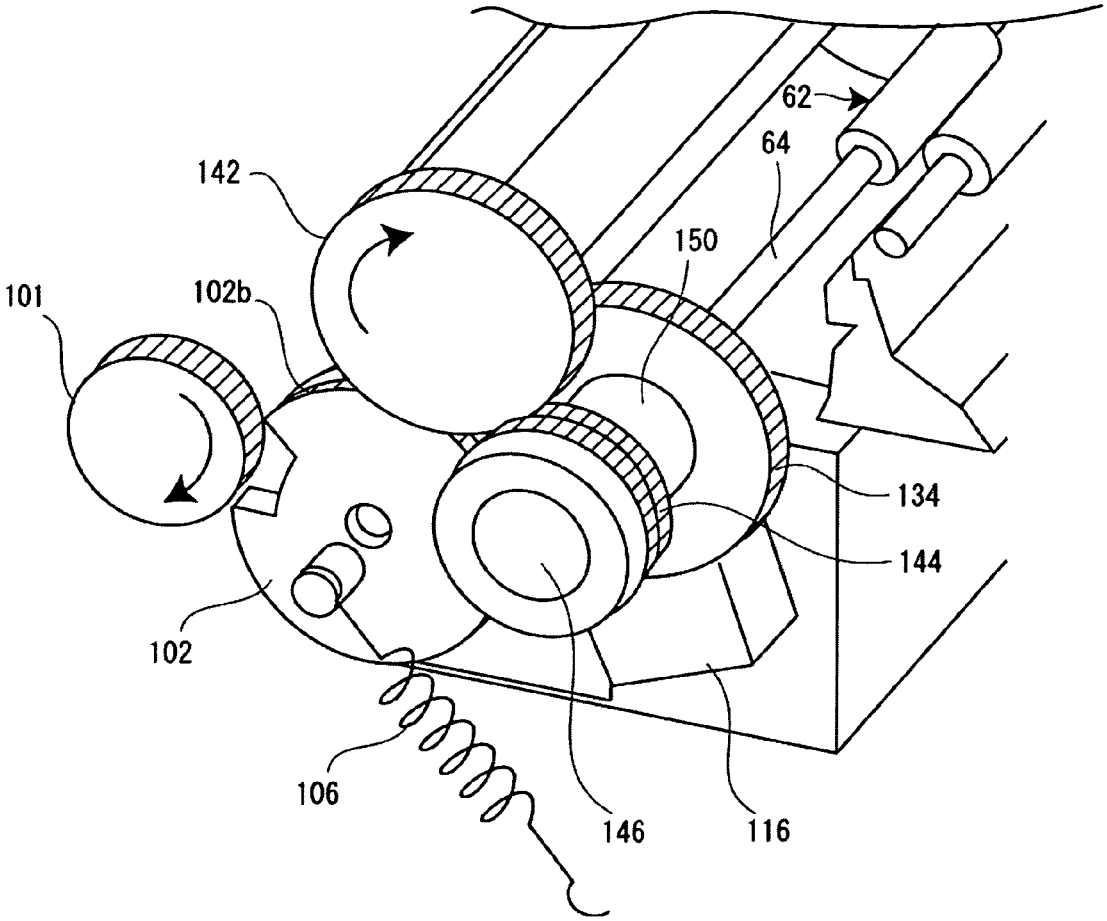
FIG. 7 is a perspective diagram showing a state upon completion of the gear array drive to transmit driving to the paper feed roller and the registration roller of the image forming apparatus according to the exemplary embodiment of the present invention, viewed from a rear position.

As shown in FIG. 7, the registration roller driving mechanism 140 has a driving gear 142 and a driven gear 144. The driving gear 142 receives drive transmission from the motor 104 and rotates. The driven gear 144, engaged with the driving gear 142, is fixed to the rotation shaft 64 via an electromagnetic clutch 146. When the driving gear 142 receives the drive transmission from the motor 104 and rotates, the rotation is transmitted to the driven gear 144 and the driven gear 144 starts rotation. Even when the driven gear 144 has started rotation, the rotation of the driven gear 144 is not transmitted to the rotation shaft 64 as long as the electromagnetic clutch 146 is OFF. On the other hand, when the electromagnetic clutch 146 is turned ON, the rotation of the driven gear 144 is transmitted to the rotation shaft 64, and the rotation shaft 64 and the registration roller 62 are rotated in the sheet conveyance direction.

The electromagnetic clutch 146, to select a state where the drive transmission from the registration roller driving mechanism 140 to the registration roller 62 is possible or a state where the drive transmission is broken, is attached to the registration roller driving mechanism 140. Further, the registration roller driving mechanism 140 is provided with a torque limiter 150. When the driving force in the same direction as the sheet conveyance direction and the driving force in the reverse direction of the sheet conveyance direction are simultaneously applied to the registration roller 62, the torque limiter 150 breaks the driving force in the reverse direction of the sheet conveyance direction to the registration roller 62.

The torque limiter 150 is attached between the driven gear 144 and the rotation shaft 64. When the driving force from the driven gear 144 in the same direction as the sheet conveyance direction and the driving force from the transmission gear 132 in the reverse direction of the sheet conveyance direction are simultaneously applied to the registration roller 62, the torque limiter 150 breaks the driving force from the transmission gear 132, to rotate the registration roller 62 in the sheet conveyance direction with the driving force transmitted from the driven gear 144.

Figure 8:
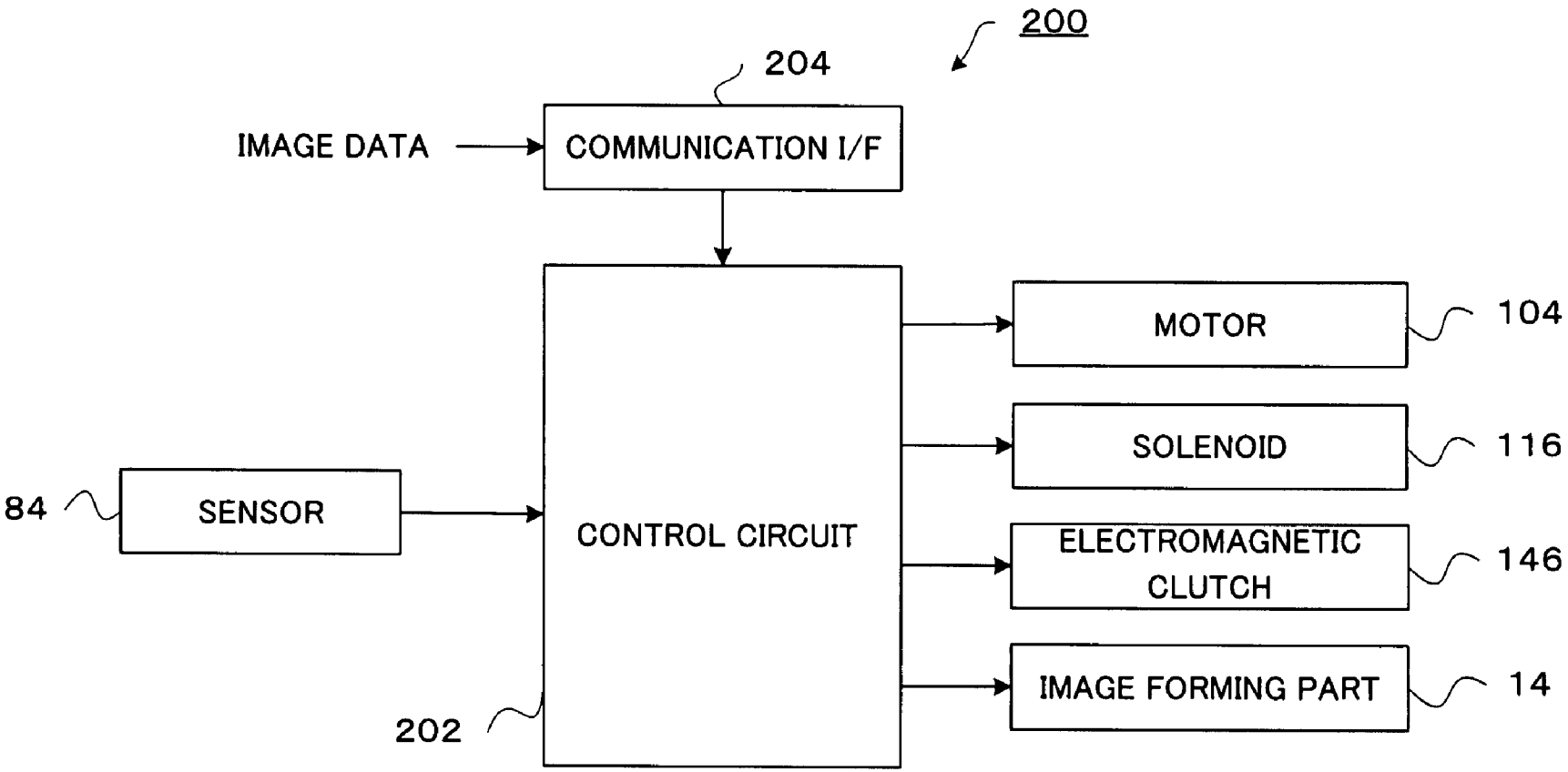
FIG. 8 is a block diagram showing a controller employed in the image forming apparatus according to the exemplary embodiment of the present invention.

FIG. 8 shows a controller 200 in the image forming apparatus 10.

The controller 200 has a control circuit 202 which inputs an output from the sensor 84. The control circuit 202 inputs image data via a communication interface 204. The image forming part 14, the motor 104, the solenoid 116 and the electromagnetic clutch 146 are controlled in accordance with an output from the control circuit 202.

Figure 9:
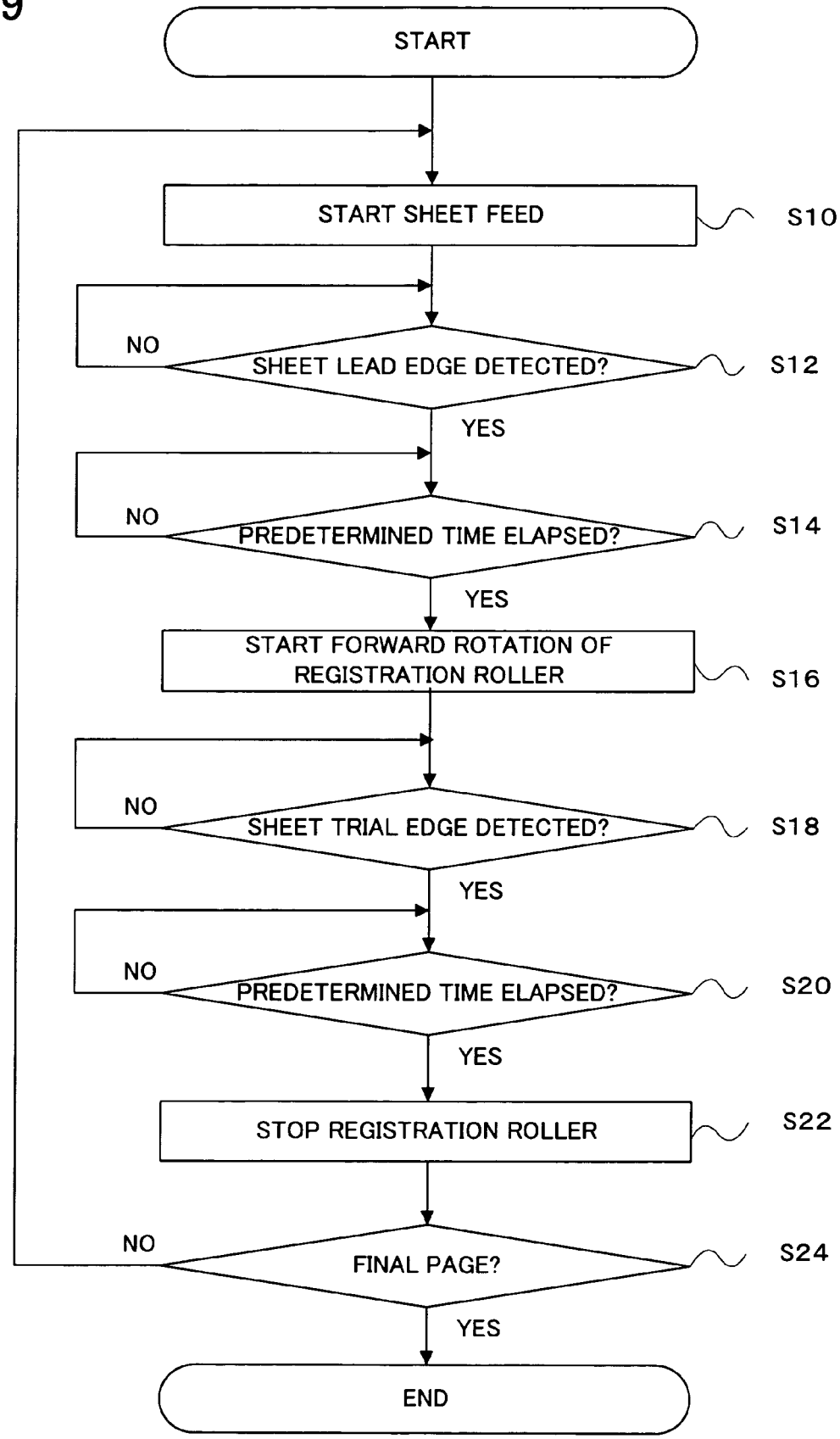
FIG. 9 is a flowchart showing an operation of the image forming apparatus according to the exemplary embodiment of the present invention.

FIG. 9 shows a control flow of the controller 200.

When image data is inputted into the control circuit 202 via the communication interface 204 and the control flow is started, the control circuit 202 starts rotation of the motor 104, and upon reception of drive transmission from the motor 104, the driving gear 101 and driving gear 142 start rotation.

At step S10, the control circuit 202 turns the solenoid 116 ON to start sheet feed. When the solenoid 116 is turned ON, the movable member 118 moves to release the engagement between the movable member 118 and the claw 112 of the cylindrical member 110. When the engagement between the movable member 118 and the claw 112 is released, the driven gear 102 is rotated by pressure of the pressure unit 106, and the driving gear 101 and the gear portion 102*b* of the driven gear 102 engage with each other. Then, in this state, drive transmission from the driving gear 101 to the driven gear 102 is performed, and the feed roller 58 rotates in the sheet conveyance direction together with the driven gear 102 and the rotation shaft 59, and sheet feed is started.

The position of the lead edge of the sheet fed with the feed roller 58 is different in accordance with whether or not the previous sheet has been fed with the handling roller 81. That is, the lead edge of the sheet is located in an end of the sheet feed cassette 56 as denoted by A (hereinbelow, a "position A") in FIG. 2A, or in a position where the feed roller 58 and the handling roller 81 are in contact with each other as denoted by B (hereinbelow, a "position B") in FIG. 2B. The time before the sheet arrives at the nip N differs in accordance with whether the lead edge of the sheet is in the position A or the position B.

At the same time of the start of rotation of the feed roller 58 and the rotation shaft 59, the transmission gear 132 fixed to the rotation shaft 59 starts rotation. Then, as shown in FIG. 6, when the gear portion 132*b* of the transmission gear 132 arrives at a position opposite to the reverse gear 134, the gear portion 132*b* of the transmission gear 132 and the reverse gear 134 engage with each other. The driving is transmitted from the transmission gear 132 to the reverse gear 134, and the registration roller 62 starts rotation in the reverse direction of the sheet conveyance direction (hereinbelow, "reverse rotation"). Then the transmission gear 132 continues the rotation, and when the gear portion 132*b* passes through the position opposite to the reverse gear 134 and the notch portion 132*a* is opposite to the reverse gear 134, the drive transmission from the transmission gear 132 to the reverse gear 134 is not performed. The drive transmission to the registration roller 62 is stopped.

Note that the position and width of the gear portion 132*b* of the transmission gear 132 are determined so as to start the reverse rotation of the registration roller 62 before the arrival of the sheet fed with the feed roller 58 at the nip N and to stop the drive transmission to the registration roller 62 for the reverse rotation after elapse of sufficient time for sheet skew correction. In this manner, upon arrival of the sheet at the nip N, as the registration roller 61 is reverse-rotating, there is no probability of insertion of the sheet in the nip N in the sheet skew correction by temporary stoppage of the conveyance of the sheet in the nip N. That is, when the lead edge of the sheet arrives at the nip N formed with the pair of registration rollers 61 in a stopped state, the lead edge of the sheet may be inserted between the rollers against a pressure-contact force applied to the two rollers forming the nip. On the other hand, in the present exemplary embodiment, as the pair of registration rollers 61 is reverse-rotating when the lead edge of the sheet arrives at the nip N, the probability of the insertion of the lead edge of the sheet between the rollers can be reduced.

Further, as the lead edge of the sheet is not easily inserted between the pair of registration rollers 61, it is not necessary to bring the registration roller 62 and the registration roller 76 in high-pressure contact for prevention of the insertion of the sheet between the registration rollers 61. In comparison with the case where the pair of registration rollers 61 are not reverse-rotated, the press-contact force to the registration roller 62 and the registration roller 76 can be reduced. Accordingly, an image formation error caused when a sheet is firmly supported with the pair of registration rollers 61 can be suppressed. That is, when a toner image is transferred onto a sheet with the transfer unit 42, the trail edge of the sheet is still firmly held between the pair of registration rollers 61. Accordingly, when the registration roller 62 and the registration roller 76 are in high-pressure contact state, the trail edge of the sheet is stretched, and a sheet conveyance speed in the transfer part is lower than a designed value and an image formation error may occur. In the present exemplary embodiment, however, the pressure force to press the registration roller 62 and the registration roller 76 in contact is comparatively low; the occurrence of such image formation error is suppressed.

Next, at step S12, a sheet end detection signal is inputted from the sensor 84 into the control circuit 202. That is, the movable member 86 of the sensor 84 provided to cross the conveyance path 60 is pushed with the lead edge of the being-conveyed sheet, then the movable member 86 is rotated about the shaft 88, and the sheet end detection signal, generated in accordance with detection of the rotation of the movable member 86 by the optical sensor, is inputted into the control circuit 202.

Next, at step S14, if it is determined that predetermined time has elapsed since the detection of the lead edge of the sheet, the control circuit 202 turns the electromagnet clutch 146 ON at step S16. When the electromagnet clutch 146 is ON, the driven gear 144 is coupled with the rotation shaft 64, and the driving of the rotation of the registration roller 62 in the sheet conveyance direction (hereinbelow, "forward rotation") is transmitted from the driven gear 144 to the rotation shaft 64. The predetermined time at step S14 is determined so as to, when a sheet with its lead edge in the position A is fed with the feed roller 58, stop the reverse-rotation driving force transmission from the transmission gear 132 to the registration roller 62, and at the same time, start the forward-rotation drive transmission from the driven gear 144 to the registration roller 62 and the rotation shaft 64.

In this manner, the timing to turn the electromagnetic clutch 146 ON is determined so as to, when a sheet with its lead edge in the position A is fed with the feed roller 58, stop the reverse-rotation driving force transmission from the transmission gear 132 to the registration roller 62, and at the same time, start the drive transmission to forward-rotate the registration roller 62 to the registration roller 62. Accordingly, when the lead edge of the sheet is in the position B, the lead edge is detected by the sensor 84 at earlier timing in comparison with the case where the lead edge of the sheet is in the position A, and the timing to start the forward-rotation driving force transmission via the driven gear 144 to the registration roller 62 is earlier. Accordingly, upon start of forward-rotation drive transmission to the registration roller 62, the reverse-rotation drive transmission from the transmission gear 132 has not been completed. When the electromagnetic clutch 146 is turned ON, the forward-rotation driving and the reverse-rotation driving are simultaneously transmitted to the registration roller 62. In this case, the reverse-rotation drive transmission via the driven gear 144 is broken by the torque limiter 150. The registration roller 62 starts forward rotation when the electromagnetic clutch 146 is turned ON. Accordingly, the probability of breakage of the transmission gear 132, the reverse gear 134, the driving gear 142, the driven gear 144 and the like is reduced, and even when the lead edge of the sheet is in the position A, the registration roller 62 starts forward rotation at the same time of completion of reverse rotation. That is, regardless of whether the lead edge of the sheet is in the position A or the position B, when the lead edge of the sheet becomes into contact with the registration roller 62, the registration roller 62 is reverse-rotating. Predetermined slag is formed in the sheet and skew correction is performed, thereafter, the registration roller 62 starts forward rotation.

The timing of turning the electromagnetic clutch 146 ON at step S16 may be determined so as to start the forward-rotation drive transmission to the registration roller 62 before the completion of the reverse-rotation drive transmission to the registration roller 62 even when the lead edge of the sheet is in the position A. In this case, the registration roller 62 infallibly starts the forward rotation at the same time of the completion of the reverse rotation. The skew of the sheet can be more excellently corrected.

When the drive transmission to forward-rotate the registration roller 62 has been performed and the registration roller 62 has started forward rotation, the sheet subjected to the skew correction at the nip N is conveyed to the image forming part 14, and in the image forming part 14, yellow, magenta, cyan and black toner images formed on the photoreceptors 22Y, 22M, 22C and 22B are sequentially transferred with the transfer rollers 50Y, 50M, 50C and 50B onto the sheet. The sheet where the four color toner images have been transferred is conveyed to the fixing device 52, and the toner image is fixed to the sheet by the fixing device 52, then discharged to the sheet discharge part 15 with the discharge roller 78. The image formation in the image forming part 14 is performed by actuation of the image forming part by the control circuit 202 after elapse of predetermined time from the input of the sheet end detection signal at step S14.

Next, at step S18, a sheet trail edge detection signal is inputted from the sensor 84 into the control circuit 202. That is, the movable member 86 of the sensor 84, pushed with the conveyed sheet and moved to a position outside of the conveyance path 60 as shown in FIG. 2B, moves to a position crossing the conveyance path 60 as shown in FIG. 2A by passing of the trail edge of the sheet around the movable member 86. Then the sheet trail edge detection signal, generated by detection of the movement by the optical sensor, is inputted into the control circuit 202.

If it is determined at step S20 that predetermined time has elapsed since the trail edge of the sheet has been detected, the control circuit 202 stops the rotation of the motor 104 at step S22, and turns the electromagnetic clutch 146 OFF, thereby stops the forward rotation of the registration roller 62. The predetermined time at step S20 is determined to be longer than the time between the detection of the trail edge of the sheet by the sensor 84 and the passing of the trail edge of the sheet through the nip N formed with the registration rollers 61.

Next, at step S24, the control circuit 202 determines whether or not the sheet subjected to the image formation is a final sheet based on data from the communication interface 204. If it is determined that the sheet is a final sheet, the control circuit 202 terminates the series of operations. Further, if it determined that the sheet is not a final sheet, the process returns to step S10, to repeat the series of image forming operations on the next sheet.

As described above, the present invention is applicable to an image forming apparatus such as a copier, a facsimile machine or a printer, and to a conveyance device to convey a conveyance subject such as a sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming part;

a first conveyance roller that conveys a recording medium to the image forming part;

a forward/reverse-rotatable second conveyance roller, located between the first conveyance roller and the image forming part in a conveyance direction of the recording medium;

a contact member, in contact with the second conveyance roller, that forms a nip between the second conveyance roller and the contact member;

a first conveyance roller driver that rotate-drives the first conveyance roller in the same direction as the conveyance direction of the recording medium; and a drive transmission mechanism that performs drive transmission from the first conveyance roller driver to the second conveyance roller so as to start rotation of the second conveyance roller in a reverse direction of the conveyance direction of the recording medium before a lead edge of the recording medium arrives at the nip, wherein the drive transmission mechanism comprises:

a drive transmission driven gear, having a notch portion and a gear portion, that rotates in accordance with rotation of the first conveyance roller; and a reverse gear, disposed opposite to the drive transmission driven gear, that does not receive drive transmission from the drive transmission driven gear when the notch portion is opposite to the drive transmission driven gear, but receives the drive transmission from the drive transmission driven gear and rotates when the gear portion is opposite to the drive transmission driven gear so as to rotate the second conveyance roller in the reverse direction of the conveyance direction of the recording medium.

2. The image forming apparatus according to claim 1, wherein the drive transmission mechanism stops the drive transmission to the second conveyance roller after arrival of the lead edge of the recording medium at the nip.

3. The image forming apparatus according to claim 1, wherein the first conveyance roller driver comprises:

a driving gear that receives drive transmission from a drive source and drives;

a driven gear disposed opposite to the driving gear, having a notch portion and a gear portion, coupled with the first conveyance roller;

a pressure unit that pressurizes the driven gear in one direction so as to preparatory-drive the driven gear to a position where the driving gear and the gear portion engage with each other;

a stop unit that causes the driven gear into a stopped state against pressure by the pressure unit;

a canceling unit that cancels the stopped state of the driven gear by the stop unit; and a controller that drives the canceling unit to cancel the stopped state of the driven gear by the stop unit.

4. The image forming apparatus according to claim 1, wherein the first conveyance roller is used as a recording medium feed roller that feeds the recording medium from a recording medium container where the recording medium is stacked.

5. The image forming apparatus according to claim 1, further comprising a second conveyance roller driver that rotates the second conveyance roller in the same direction as the conveyance direction of the recording medium.

6. The image forming apparatus according to claim 5, further comprising a controller that controls timing of drive transmission from the second conveyance roller driver to the second conveyance roller so as to start the drive transmission from the second conveyance roller driver to the second conveyance roller when the drive transmission to the second conveyance roller by the drive transmission mechanism has been stopped.

7. The image forming apparatus according to claim 5, further comprising a selection unit that selects a state where the drive transmission from the second conveyance roller driver to the second conveyance roller is possible or a state where the drive transmission from the second conveyance roller driver to the second conveyance roller is stopped.

8. The image forming apparatus according to claim 7, further comprising a controller that controls the selection unit so as to start the drive transmission from the second conveyance roller driver to the second conveyance roller when the drive transmission to the second conveyance roller by the drive transmission mechanism has been stopped.

9. The image forming apparatus according to claim 5, further comprising:

a detection unit that is provided upstream of the nip in the conveyance direction of the recording medium and that detects the recording medium; and a controller that controls timing of the drive transmission from the second conveyance roller driver to the second conveyance roller, based on the detection of the detection unit.

10. The image forming apparatus according to claim 5 further comprising:

a detection unit that is provided upstream of the nip in the conveyance direction of the recording medium and that detects the recording medium; and a controller that controls timing of selection of the state where the drive transmission from the second conveyance roller driver to the second conveyance roller is possible by the selection unit, based on the detection of the detection unit.

11. The image forming apparatus according to claim 1, further comprising:

a detection unit that is provided upstream of the nip in the conveyance direction of the recording medium and that detects the recording medium; and a controller that controls timing of start of image formation by the image forming part, based on the detection of the detection unit.

12. The image forming apparatus according to claim 1, further comprising:

a detection unit that is provided upstream of the nip in the conveyance direction of the recording medium and that detects a trail edge of the recording medium; and a controller that controls timing of start of conveyance of a recording medium to be used next with the first conveyance roller, based on the detection of the detection unit.

13. The image forming apparatus according to claim 5, further comprising a drive transmission stop unit that stops drive transmission in the reverse direction of the conveyance direction of the recording medium when the drive transmission in the reverse direction of the conveyance direction of the recording medium by the drive transmission mechanism and the drive transmission in the same direction as the conveyance direction of the recording medium from the second conveyance roller driver are simultaneously performed with respect to the second conveyance roller.

14. A conveyance device comprising:

a first conveyance roller that conveys a conveyance subject;

a second conveyance roller located downstream from the first conveyance roller in a conveyance direction of the conveyance subject;

a contact member, in contact with the second conveyance roller, that forms a nip between the second conveyance roller and the contact member;

a first conveyance roller driver that rotate-drives the first conveyance roller in the same direction as the conveyance direction of the conveyance subject; and a drive transmission mechanism that performs drive transmission from the first conveyance roller driver to the second conveyance roller so as to start rotation of the second conveyance roller in a reverse direction of the conveyance direction of the conveyance subject before a lead edge of the conveyance subject arrives at the nip, wherein the drive transmission mechanism comprises:

a drive transmission driven gear, having a notch portion and a gear portion, that rotates in accordance with rotation of the first conveyance roller; and a reverse gear, disposed opposite to the drive transmission driven gear, that does not receive drive transmission from the drive transmission driven gear when the notch portion is opposite to the drive transmission driven gear, but receives the drive transmission from the drive transmission driven gear and rotates when the gear portion is opposite to the drive transmission driven gear so as to rotate the second conveyance roller in the reverse direction of the conveyance direction of the recording medium.

15. An image forming apparatus comprising:

means for forming an image;

a first conveyance means for conveying a recording medium to the means for forming an image;

a forward/reverse-rotatable second conveyance means, located between the first conveyance means and the means for forming an image in a conveyance direction of the recording medium;

a contact means, in contact with the second conveyance means, for forming a nip between the second conveyance means and the contact means;

a first conveyance means driving means for rotate-driving the first conveyance means in the same direction as the conveyance direction of the recording medium; and a drive trans ss on means for performing drive transmission from the first conveyance means driving means to the second conveyance means so as to start rotation of the second conveyance means in a reverse direction of the conveyance direction of the recording medium before a lead edge of the recording medium arrives at the nip, wherein the drive transmission mechanism comprises:

a drive transmission driven gear, having a notch portion and a gear portion, that rotates in accordance with rotation of the first conveyance roller; and a reverse gear, disposed opposite to the drive transmission driven gear, that does not receive drive transmission from the drive transmission driven gear when the notch portion is opposite to the drive transmission driven gear, but receives the drive transmission from the drive transmission driven gear and rotates when the gear portion is opposite to the drive transmission driven gear so as to rotate the second conveyance roller in the reverse direction of the conveyance direction of the recording medium.

* * * * *